United States Patent [19]

Biegel

[11] Patent Number: 4,802,427

[45] Date of Patent: Feb. 7, 1989

[54] SHIP HULL CONSTRUCTION

[75] Inventor: Donald R. Biegel, Napa, Calif.

[73] Assignee: Tri-Albi Corporation, Napa, Calif.

[21] Appl. No.: 155,876

[22] Filed: Feb. 16, 1988

Related U.S. Application Data

[63] Continuation of Ser. No. 892,310, Aug. 4, 1986, abandoned.

[51] Int. Cl.[4] ..... B63B 1/12

[52] U.S. Cl. ..... 114/61; 114/123; 114/283

[58] Field of Search ..... 114/61, 123, 283, 292, 114/278, 279

[56] References Cited

U.S. PATENT DOCUMENTS

| | | | |
|---|---|---|---|
| Re. 26,434 | 8/1968 | Bowles | 114/278 |
| 2,052,991 | 9/1936 | Stack | 114/61 |
| 3,430,595 | 3/1969 | Talleners | 114/61 |
| 3,447,502 | 6/1969 | Leopold | 114/61 |
| 3,763,811 | 10/1973 | Danahy | 114/279 |
| 3,897,744 | 8/1975 | Lang | 114/61 |
| 4,345,533 | 8/1982 | Kunitake | 114/61 |

FOREIGN PATENT DOCUMENTS

| | | | |
|---|---|---|---|
| 2207980 | 8/1973 | Fed. Rep. of Germany | 114/61 |
| 1543162 | 10/1968 | France | 114/61 |
| 268198 | 6/1973 | U.S.S.R. | 114/61 |
| 850486 | 7/1981 | U.S.S.R. | 114/61 |
| 2047631 | 12/1980 | United Kingdom | 114/283 |

*Primary Examiner*—Sherman D. Basinger
*Assistant Examiner*—Thomas J. Brahan

[57] ABSTRACT

A ship hull construction comprises an upper main hull having a keel and three submerged substantially cylindrical sub-hulls, one sub-hull being located directly beneath the keel of the main hull, the other two sub-hulls being located above and to opposite sides of said one sub-hull, each sub-hull being mounted to the underside of said main hull and imparting buoyancy thereto, whereby the sub-hulls produce an advantageous hydraulic lift that softens entry of the main hull and dampen pitch, roll and yaw.

12 Claims, 1 Drawing Sheet

SHIP HULL CONSTRUCTION

This application is a continuation of application Ser. No. 06/892,310, filed 3-4-86 now abandoned.

BACKGROUND OF THE INVENTION

This invention relates generally to vessels that employ sub-hulls to reduce drag and improve stability. Vessels of this kind are disclosed in U.S. Pat. Nos. 4,452,166, 4,345,533, 3,960,100, 3,897,744, 3,842,772, 3,623,444, 3,541,987 and 3,447,502. In general, most of these prior art patents are concerned with improving the stability and speed of a vessel by the use of submerged cylindrical hulls either alone or in conjunction with a platform.

SUMMARY OF THE INVENTION

The present invention is more particularly directed to a vessel having a main hull formed with a substantially V-shaped bottom and the use of three submerged cylindrical sub-hulls. The relative size, shape and position of the sub-hulls relative to the main hull is extremely important to buoyancy, stability and overall speed of the vessel; and applicant has discovered that certain design relationships exist for vessels of this kind. Those relationships include: the overall length of the main hull in relation to the diameter and length of each submerged sub-hull; the distances between sub-hulls; and the distances between each sub-hull and the keel of the main hull.

The primary object of the present invention is to provide a vessel formed with a main hull and three submerged substantially cylindrical sub-hulls that cooperate in an arrangement to enhance buoyancy, stability and speed of the vessel, particularly in heavy weather.

Other objects of this invention will become apparent in view of the following detailed description.

Figure 1:
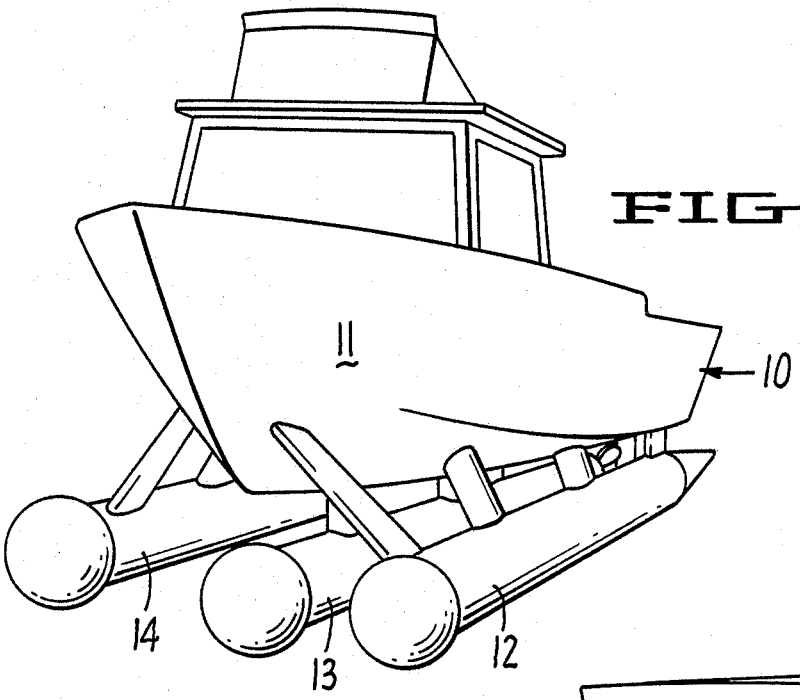
Figure 2:
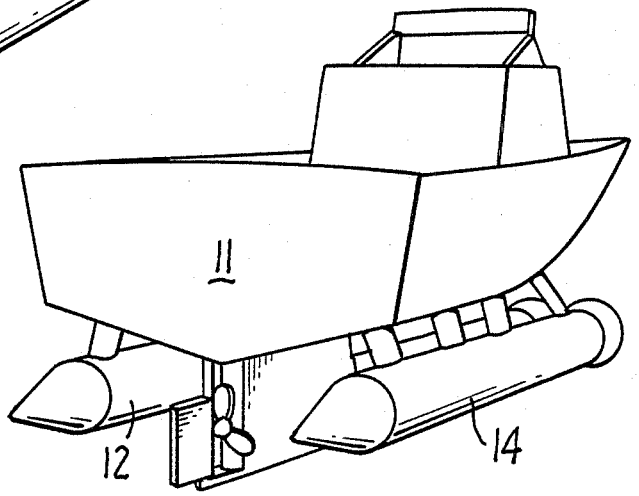
Figure 3:
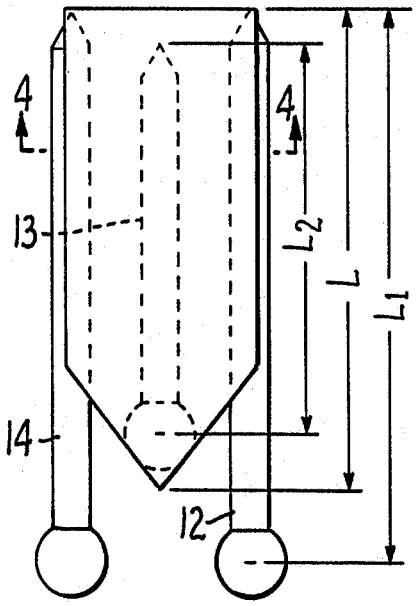
Figure 4:
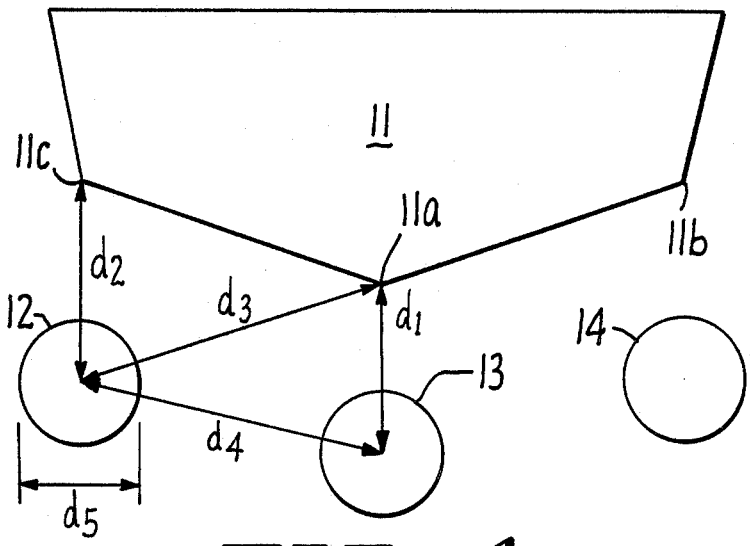

In the drawings forming a part of this application and in which like parts are identified by like reference numerals throughout the same, FIGS. 1 and 2 are perspective views of a preferred embodiment in a vessel constructed in accordance with this invention;

FIG. 3 is a plan layout of the main hull and three sub-hulls used with the preferred embodiment; and FIG. 4 is a transverse section taken on lines 4—4 of FIG. 3 showing the relative size and distance relationships of the main hull and sub-hulls.

Referring to the drawings, FIG. 1 illustrates a preferred embodiment of the invention in a vessel 10 comprising a main hull 11 having a substantially V-shaped bottom, including a keel 11*a* and chines 11*b*,11*c* and three submerged cylindrical sub-hulls 12, 13 and 14, each mounted to the underside of the main hull by a plurality of struts. The front or lead end of each sub-hull is preferably formed with a spherical surface; and the rear end of each sub-hull is conically tapered. The spherical surfaces essentially break the water in advance of the sub-hull and provide buoyancy that lifts and softens entry of the main hull in the water. The conical surfaces tend to reduce turbulence and enhance the flow of water in a manner common to the art.

Both the size of the spherical surfaces at the lead ends and the length of the conical taper at the trailing ends are important to optimum performance of the sub-hulls, and the size and length of those surfaces depend upon the overall length of the main hull. In that connection, the preferred diameter of each spherical surface is approximately 10% of the main hull length; and the preferred length of each conical surface is approximately 9% of that length.

Sub-hulls 12 and 14 are located approximately below chines 11*b*,11*c* and equal distances from keel 11*a* and the center of sub-hull 13; and sub-hull 13 is located directly below the keel. As a consequence, the buoyancy center of sub-hull 13 is approximately twice the distance below keel 11*a* as are the buoyancy centers of sub-hulls 12 and 14. Accordingly, as vessel 10 rolls to the left or port side (as viewed in FIG. 4), the buoyancy center of sub-hull 12 moves downward and outward relative to the buoyancy center of sub-hull 13. At the same time, the buoyancy center of sub-hull 14 moves upward and inward towards the buoyancy center of sub-hull 13. The combined effect of these motions results in a corrective buoyancy force which, applied to the main hull, tend to inhibit roll to the port side. A similar corrective buoyancy force occurs when the vessel rolls to the right or starboard.

The arrangement of submerged sub-hulls relative to main hull 11 is of particular importance to effective dampening of the roll and yaw movements of the vessel. Each sub-hull coacts with the main hull and with at least one other sub-hull in throttling the flow of water through five throat areas. With reference to FIG. 4, a first throat area of water movement exists between keel 11*a* and the center sub-hull 13; second and third throat areas are provided between chines 11*b*, 11*c* and sub-hulls 14 and 12, respectively; and fourth and fifth throat areas are formed between sub-hull 13 and sub-hulls 12 and 14. The size of each throat area, particularly that between keel 11*a* and center sub-hull 13, is important to the effectiveness of the sub-hulls in dampening roll and yaw motions.

Both the size and length of each sub-hull, as well as its arrangement relative to the main hull and to each other sub-hull, are factors to the overall operation and stability of the vessel For practical reasons, it is preferred that sub-hull 13 be constructed shorter in length than main hull 11. The bow and stern are then open areas for anchoring the vessel. A preferred construction of the invention also utilizes sub-hulls 12 and 14 that are longer than main hull 11 and project forwardly thereof to impart additional buoyancy and stability against pitching of the vessel. As shown, sub-hulls 12 and 14 are approximately 50% greater in length, volume displacement and buoyancy as compared with sub-hull 13.

In general, the overall length of the main hull may be used as a basis for the design of each sub-hull. More specifically, the length of the main hull, the length of the sub-hulls, the relative size and location of the sub-hulls to each other and to the bottom of the main hull are important to optimum performance. There, as shown in the drawings, $L$ = Length of main hull 11;

$L_1$ = Length of outside submerged hulls 12 and 14;

$L_2$ = Length of center submerged hull 13;

$d_1$ = Distance between buoyancy center of sub-hull 13 and keel 11*a*;

$d_2$ = Distance between buoyancy center of sub-hulls 12 and 14 to chines 11*b* and 11*c*;

$d_3$ = Distance from buoyancy center of sub-hulls 12 and 14 to keel;

$d_4$ = Distance from buoyancy center of sub-hulls 12 and 14 to buoyancy center of sub-hull 13;

$d_5$ = Diameter of each sub-hull; and c=a constant equal to 0.076±0.01;

it has been determined empirically and mathematically that the following formulations and relationships provide optimum performance $L_1$=15 Lc $L_2$=10 Lc $d_1$=0.82 Lc $_2$=1.55 Lc $d_3$=2.72 Lc $d_4$=2.72 Lc $d_5$=Lc Although a preferred embodiment of the invention has been illustrated and described, various modifications and changes may be resorted to without departing from the spirit of the invention or the scope of the appended claims, and each of such modifications and changes is contemplated.

What is claimed is:

1. A ship hull construction comprising an upper main buoyant hull having a generally V-shaped bottom including a submerged keel and chines, and three submerged substantially cylindrical sub-hulls, one sub-hull being located directly beneath the keel of the main hull, the other two sub-hulls being located above and to opposite sides of said one sub-hull, each sub-hull being mounted to the underside of said main hull and imparting a constant buoyancy force thereto; whereby said V-shaped bottom and sub-hulls cooperatively define five throat areas through which water movement occurs to dampen roll and yaw movements of the ship hull without changing the total buoyancy force of said sub-hulls, said five throat areas being a first throat area defined by said keel and said one sub-hull, said second and third throat areas being defined by said other two sub-hulls and their respective chines, and said fourth and fifth sub-hulls being defined by said one sub-hull and each of said other two sub-hulls.

2. The ship hull construction of claim 1, the center of said one sub-hull being approximately twice the distance below the keel as are the centers of said other two sub-hulls: whereby a roll of the ship hull to either side shifts the effective buoyancy imparted to said main hull by said three sub-hulls and tends to return the ship hull to a neutral position.

3. The ship hull construction of claim 1, each of said other two sub-hulls having a length, volume displacement and buoyancy approximately 50% greater than that of said one sub-hull.

4. The ship hull construction of claim 1, the diameter of each sub-hull being substantially the same and equal to Lc, where "L" equals the length of said main hull and "c" equals the value 0.076 plus or minus 0.01.

5. The ship hull construction of claim 1, said main hull being formed with a generally V-shaped bottom and sides that meet at a chine, the distance from the chine of said main hull to the center of each of said other two sub-hulls being equal to 1.55 Lc, where "L" equals the length of said main hull and "c" equals the value 0.076 plus or minus 0.01.

6. The ship hull construction of claim 1, the distance between the center line of each of said other two sub-hulls to the keel of said main hull being 2.72 Lc, where "L" equals the length of said main hull and "c" equals the value 0.076 plus or minus 0.01.

7. The ship hull construction of claim 1, the vertical distance between from the center line of each one sub-hull to the keel of said main hull being 0.82 Lc, where "L" equals the length of said main hull and "c" equals the value 0.076 plus or minus 0.01.

8. The ship hull construction of claim 1, the length of said one sub-hull being 10 Lc, where "L" equals the length of said main hull and "c" equals the value 0.076 plus or minus 0.01.

9. The ship hull construction of claim 1, the length of said other two sub-hulls being 15 Lc, where "L" equals the length of said main hull and 37 c" equals the value 0.076 plus or minus 0.01.

10. The ship hull construction of claim 1, the distance from the center line of said one sub-hull to the center lines of said other two sub-hulls being 2.72 Lc, where "L" equals the length of said main hull and "c" equals the value 0.076 plus or minus 0.01.

11. The ship hull construction of claim 1, the forward end of each sub-hull being substantially spherical in shape and having a diameter approximately 10% of the main hull length.

12. The ship hull construction of claim 1, the rear end of each sub-hull being substantially conical in shape and having a tapered length approximately 9% of the main hull length.

* * * * *